US011415392B2

(12) United States Patent
Munsell

(10) Patent No.: US 11,415,392 B2
(45) Date of Patent: Aug. 16, 2022

(54) ARCHERY VIEWFINDER

(71) Applicant: HAMSKEA ARCHERY SOLUTIONS LLC, Frederick, CO (US)

(72) Inventor: Andrew W. Munsell, Brighton, CO (US)

(73) Assignee: HAMSKEA ARCHERY SOLUTIONS LLC, Frederick, CO (US)

( * ) Notice: Subject to any disclaimer, the term of this patent is extended or adjusted under 35 U.S.C. 154(b) by 246 days.

(21) Appl. No.: 16/811,617

(22) Filed: Mar. 6, 2020

(65) Prior Publication Data

US 2020/0292277 A1 Sep. 17, 2020

Related U.S. Application Data

(60) Provisional application No. 62/816,896, filed on Mar. 11, 2019.

(51) Int. Cl.
*F41G 1/467* (2006.01)
*F41B 5/14* (2006.01)

(52) U.S. Cl.
CPC ..... *F41G 1/467* (2013.01); *F41B 5/1419* (2013.01)

(58) Field of Classification Search
CPC ..... F41G 1/467; F41B 5/1419
USPC ..... 33/265; 124/87, 90
See application file for complete search history.

(56) References Cited

U.S. PATENT DOCUMENTS

| | | | | |
|---|---|---|---|---|
| 605,892 | A | 6/1898 | Miller | |
| 697,357 | A | 4/1902 | Peak et al. | |
| 2,083,934 | A | 6/1937 | Arden | |
| 2,125,932 | A | 8/1938 | Lennon | |
| 2,814,284 | A | 11/1957 | Sileo | |
| 2,842,114 | A | 7/1958 | Duncan | |
| 3,410,644 | A | 11/1968 | McLendon | |
| 3,431,652 | A | 3/1969 | Leatherwood | |
| 3,703,770 | A | 11/1972 | Sofield | |
| 3,703,771 | A * | 11/1972 | Saunders | F41B 5/1419 124/90 |
| 3,859,733 | A | 1/1975 | Chesnick | |

(Continued)

OTHER PUBLICATIONS

"World Archery Kit", 3 pages, Archery Easier, available at: https://ultraviewarchery.com/collections/the-ultraview-2/products/world-archery-kitD86959, at least as early as Mar. 2, 2020.

(Continued)

*Primary Examiner* — Alexander R Niconovich
(74) *Attorney, Agent, or Firm* — Trenner Law Firm, LLC; Mark D. Trenner

(57) ABSTRACT

An archery viewfinder is disclosed. An example archery viewfinder may include a viewfinder housing having a cylindrical shape. The viewfinder may be mounted on one or both of a front toward target position and a rear toward user position in an archery bow system. The archery viewfinder may also include at least one light baffle in the viewfinder housing. The at least one light baffle is formed by a first diameter of the viewfinder forming adjacent ridges and a second diameter of the viewfinder housing forming a groove between the adjacent ridges. A combination of the geometrically parallel shape and the at least one light baffle substantially reduces or even fully eliminates incident stray light from causing glare when viewed or observed by the user.

21 Claims, 20 Drawing Sheets

(56) References Cited

U.S. PATENT DOCUMENTS

| | | | | |
|---|---|---|---|---|
| 3,922,795 | A | 12/1975 | Bettencourt | |
| 4,011,853 | A | 3/1977 | Fletcher | |
| 4,217,026 | A | 8/1980 | Radovich | |
| 4,375,725 | A | 3/1983 | Orlob | |
| 4,395,096 | A | 7/1983 | Gibson | |
| 4,542,963 | A | 9/1985 | Linlor | |
| 4,552,121 | A | 11/1985 | Treaster | |
| 4,656,747 | A | 4/1987 | Troncoso | |
| 4,833,786 | A * | 5/1989 | Shores, Sr. | F41G 1/01 42/133 |
| 5,004,332 | A | 4/1991 | Edwards | |
| 5,093,837 | A | 3/1992 | Edwards | |
| 5,121,251 | A | 6/1992 | Edwards | |
| 5,225,931 | A | 7/1993 | Stavroudis | |
| 5,347,976 | A * | 9/1994 | Saunders | F41G 1/467 124/90 |
| 5,367,780 | A | 11/1994 | Savage | |
| 5,371,369 | A | 12/1994 | Kent | |
| 5,669,146 | A * | 9/1997 | Beutler | F41B 5/1419 124/87 |
| 5,697,357 | A | 12/1997 | Chipman | |
| 5,697,358 | A | 12/1997 | Campisi | |
| 5,860,408 | A | 1/1999 | Summers | |
| 6,024,458 | A | 2/2000 | Lundgren | |
| 6,058,921 | A * | 5/2000 | Lawrence | F41B 5/1419 124/87 |
| 6,170,164 | B1 | 1/2001 | Knowles | |
| 6,239,922 | B1 | 5/2001 | Nakamura | |
| 6,282,800 | B1 | 9/2001 | Beutler | |
| 6,360,473 | B1 | 3/2002 | Merchant | |
| 6,802,129 | B1 | 10/2004 | Wirth | |
| 7,047,652 | B1 | 5/2006 | Chipman | |
| 7,266,896 | B1 | 9/2007 | White | |
| 7,286,295 | B1 | 10/2007 | Sweatt et al. | |
| 7,373,723 | B1 | 5/2008 | Tupper, Jr. | |
| 7,461,460 | B2 | 12/2008 | Priebe | |
| 7,543,389 | B2 * | 6/2009 | Grace, Jr. | F41B 5/1419 124/87 |
| 7,698,824 | B2 | 4/2010 | Wilson | |
| 7,762,677 | B2 | 7/2010 | Lundgren | |
| 7,975,391 | B1 | 7/2011 | Gillingham et al. | |
| 8,000,010 | B2 | 8/2011 | Crandall | |
| 8,125,628 | B1 | 2/2012 | Lones | |
| 8,161,656 | B1 | 4/2012 | Eligass | |
| 8,176,644 | B1 | 5/2012 | Summers et al. | |
| 8,191,544 | B2 | 6/2012 | Buck | |
| 8,201,339 | B1 * | 6/2012 | Walker | F41G 1/467 124/87 |
| 8,453,336 | B2 | 6/2013 | LoRocco | |
| 8,544,180 | B2 | 10/2013 | Minica | |
| 8,544,457 | B1 | 10/2013 | Munsell et al. | |
| 9,285,188 | B1 | 5/2016 | LoRocco et al. | |
| 9,829,278 | B2 | 11/2017 | Wolf | |
| 9,921,033 | B2 | 3/2018 | Johnson | |
| 10,012,473 | B2 * | 7/2018 | Munsell | F41B 5/1419 |
| 10,161,719 | B2 * | 12/2018 | Burgaleta Sanchez | F41G 1/467 |
| D869,591 | S | 12/2019 | Schuster | |
| 10,852,096 | B2 * | 12/2020 | Schuster | F41G 1/467 |
| 2005/0088748 | A1 | 4/2005 | Otteman | |
| 2007/0050998 | A1 | 3/2007 | Myers | |
| 2008/0066328 | A1 | 3/2008 | Bohn | |
| 2008/0289201 | A1 | 11/2008 | Kroening, Jr. | |
| 2009/0007445 | A1 | 1/2009 | Bach | |
| 2011/0186028 | A1 | 8/2011 | VandeWater | |
| 2012/0180329 | A1 | 7/2012 | Priebe | |
| 2015/0338190 | A1 | 11/2015 | Johnson | |
| 2017/0010069 | A1 | 1/2017 | Mason et al. | |
| 2018/0066919 | A1 * | 3/2018 | Burgaleta Sanchez | F41G 1/467 |
| 2018/0080737 | A1 | 3/2018 | Gohlke | |
| 2018/0112950 | A1 * | 4/2018 | Munsell | F41B 5/1419 |

OTHER PUBLICATIONS

"Podium Peep Apertures", 4 pages, Specialty Archery L.L.C., available at: https://specialtyarch.com/podium-peep-apertures, at least as early as Mar. 2, 2020.

Hamskea Archery Solutions "RAPTOR PEEP™" available at https://www.hamskeaarchery.com/product/raptor-peep/; printed from Internet Apr. 5, 2022; Note: the RAPTOR PEEP™ product was made commercially available by Applicant on Dec. 15, 2017.

* cited by examiner

ARCHERY VIEWFINDER

CROSS REFERENCE TO RELATED APPLICATIONS

This application claims the priority benefit of U.S. Provisional Patent Application No. 62/816,896 filed Mar. 11, 2019 for "Archery View Finder," of Andrew W. Munsell, hereby incorporated by reference in its entirety as though fully set forth herein.

BACKGROUND

A "viewfinder" in archery may refer to a "peep" style viewfinder that is commonly mounted on the bow string, or the forward sight that is mounted to the bow riser. In either case, light reflecting off of a smooth surface of the viewfinder can produce glare, inhibiting its use. Reflected light follows the fundamental principles of physics that define the angle of reflected light to be equal to the angle of the incoming incident light. Thus, a longer continuous smooth surface on the viewfinder provides a greater surface area to reflect light, causing more and/or brighter glare for the user.

DETAILED DESCRIPTION

Figure 1:
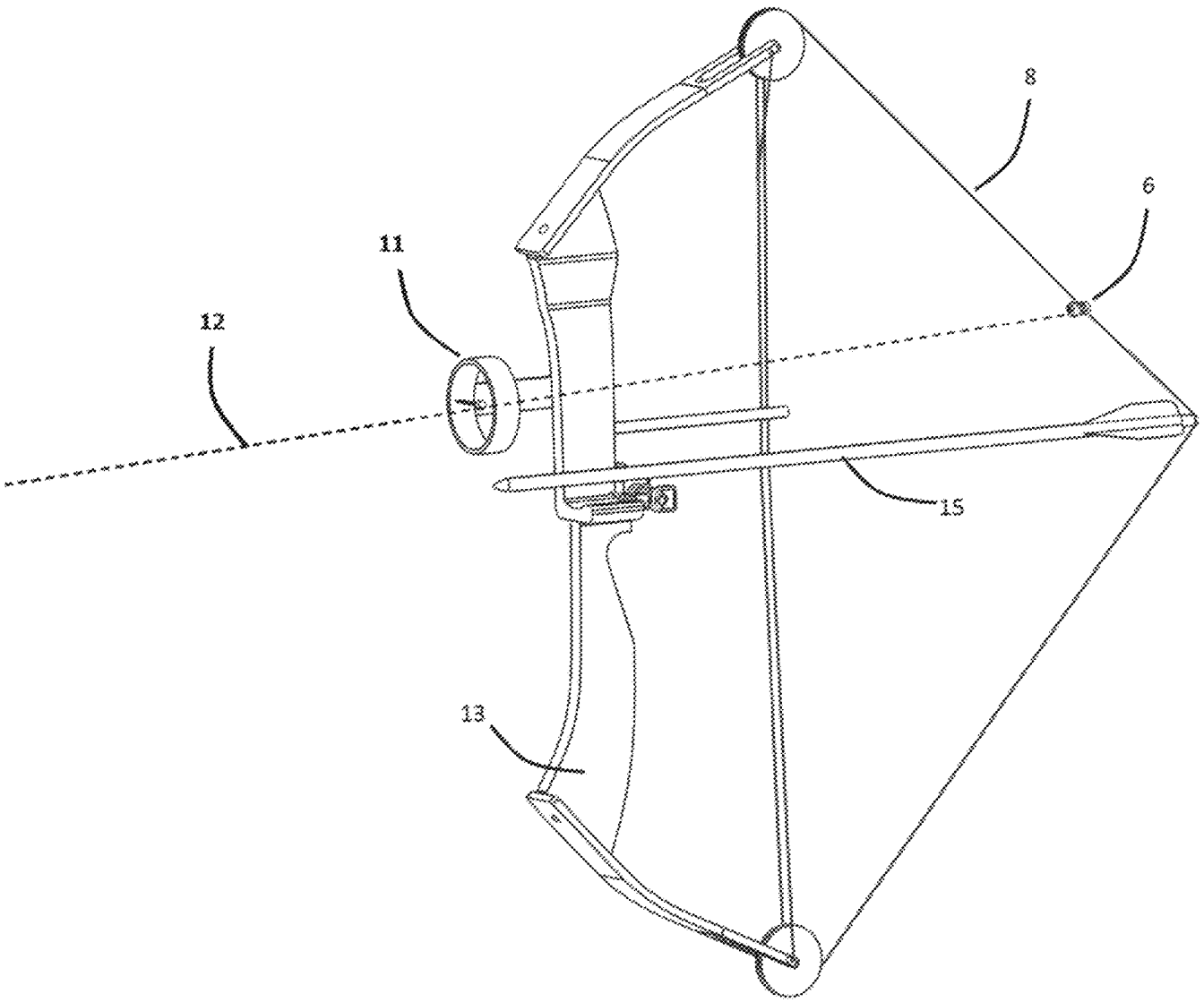
FIG. 1 is a perspective of an archery system which may implement one or more viewfinder.

FIG. 1 is a perspective of an archery system which may implement one or more viewfinder. The archery sighting system includes a front viewfinder 11 mounted on a bow 13 and aft viewfinders 6 mounted in the string 8 that are coaxial aligned to form a line of sight 12 to the target 10.

With traditional viewfinders, various lighting conditions cause glare based on the surface geometries of these viewfinders. The simple fix for glare is to provide a light shade. Early light shades were smooth cylindrical tube extensions forward and aft of the main body/structure of the viewfinder(s). This was an improvement but glare was still an issue. To combat glare in a tube-shaped viewfinder, conical shapes were introduced which reduce glare while simultaneously enabling a larger field if the viewfinder were to rotate or twist relative to the line of sight 12.

However, even these conical surfaces, when misaligned (rotated about their geometric center 14) compared to their intended geometry relative to the line of sight 12, still can generate stray light. Rotation of the viewfinders can be caused by the string 8 twisting and the bow 13 torquing about the handle. If either viewfinder has forward 30 or aft 32 flat continuous surfaces, the result will be glare 31 and 33 propagated to the user resulting in a less than clear observed target 10 scene. When glare is present in an optical system, the observed target scene can be unresolvable causing accuracy of the user to suffer.

Both cylindrical and cone geometries help, but still do not fully address the issue of glare. Incident light impinging on the inside of the viewfinder may still generate glare 31, 33, as illustrated in FIGS. 2-5. FIGS. 2-5 illustrate prior art cylindrical shaped viewfinders, shown both aligned and misaligned.

Figure 2:
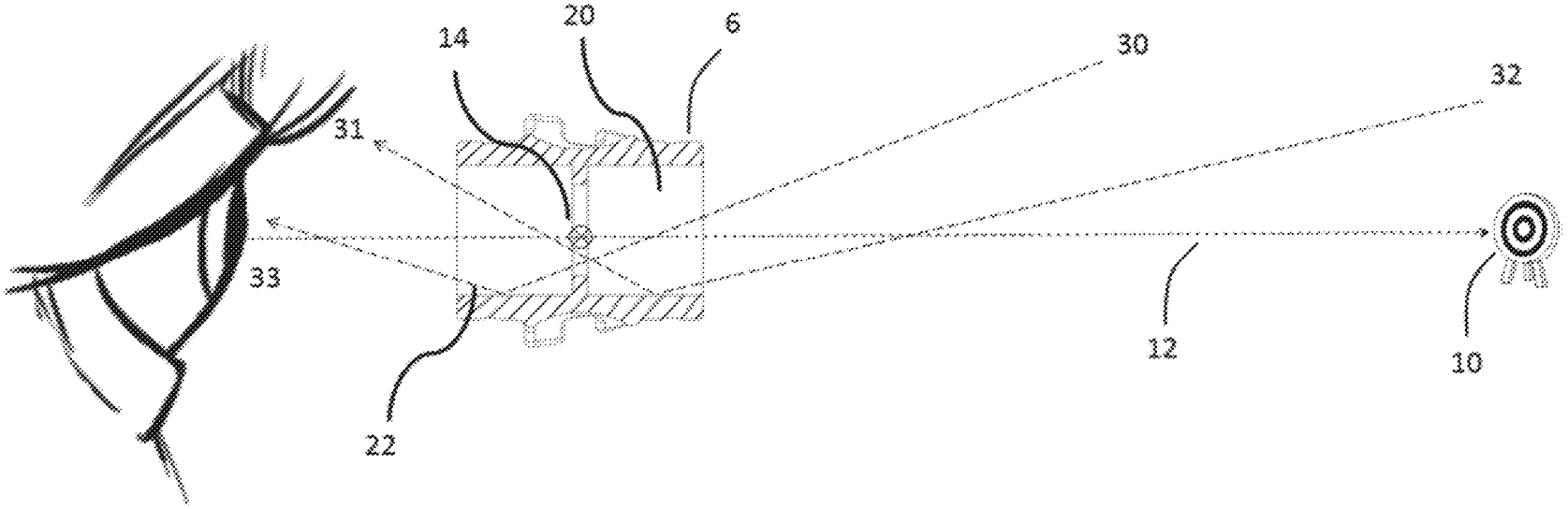
PRIOR ART Fig. 2
FIGS. 2-5 illustrate prior art cylindrical shaped viewfinders, shown both aligned and misaligned.
Figure 3:
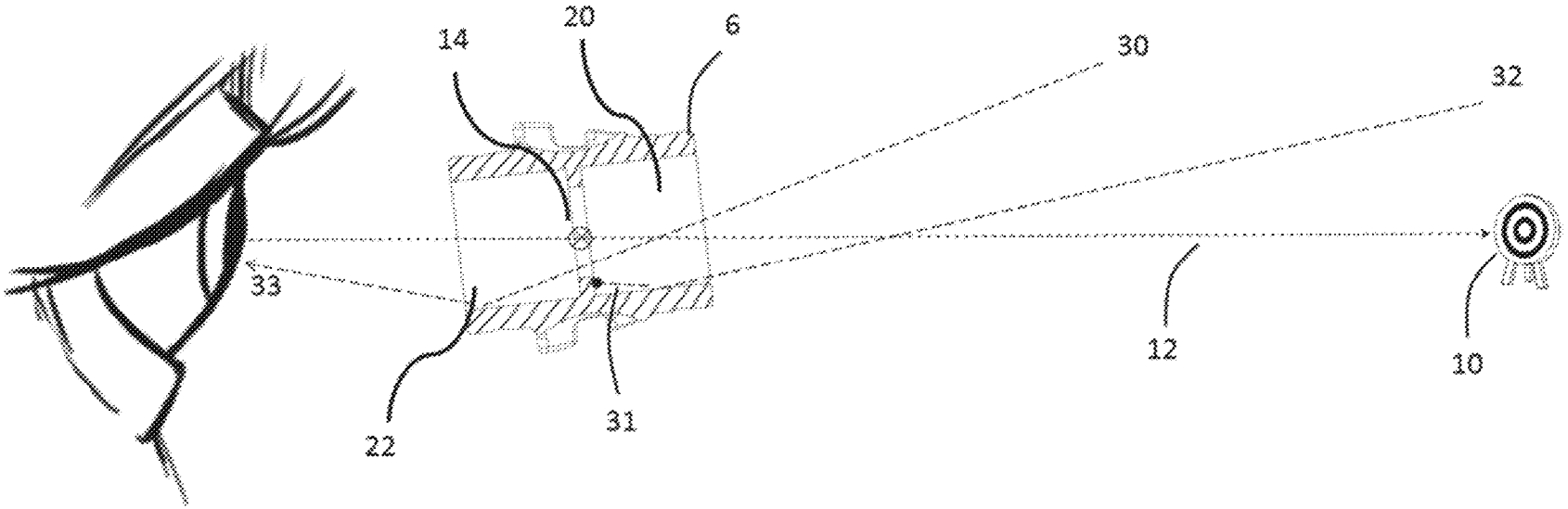
PRIOR ART Fig. 3
Figure 4:
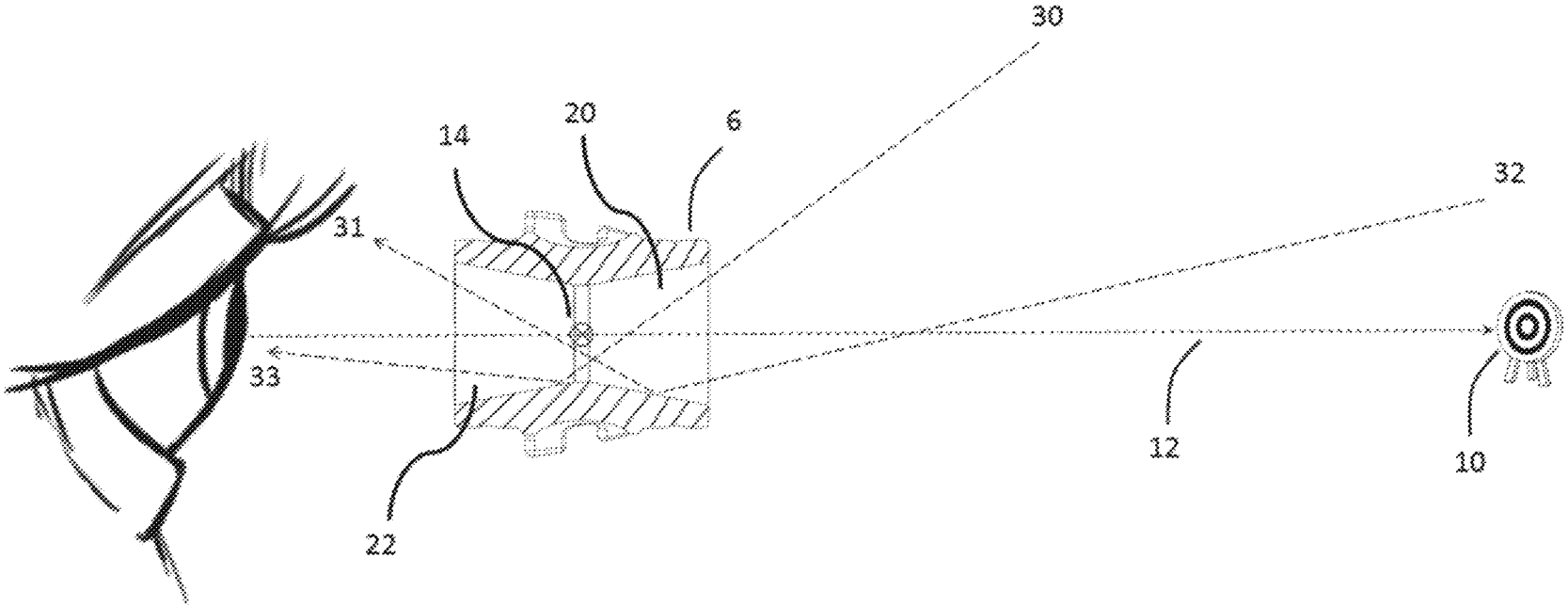
PRIOR ART Fig. 4
Figure 5:
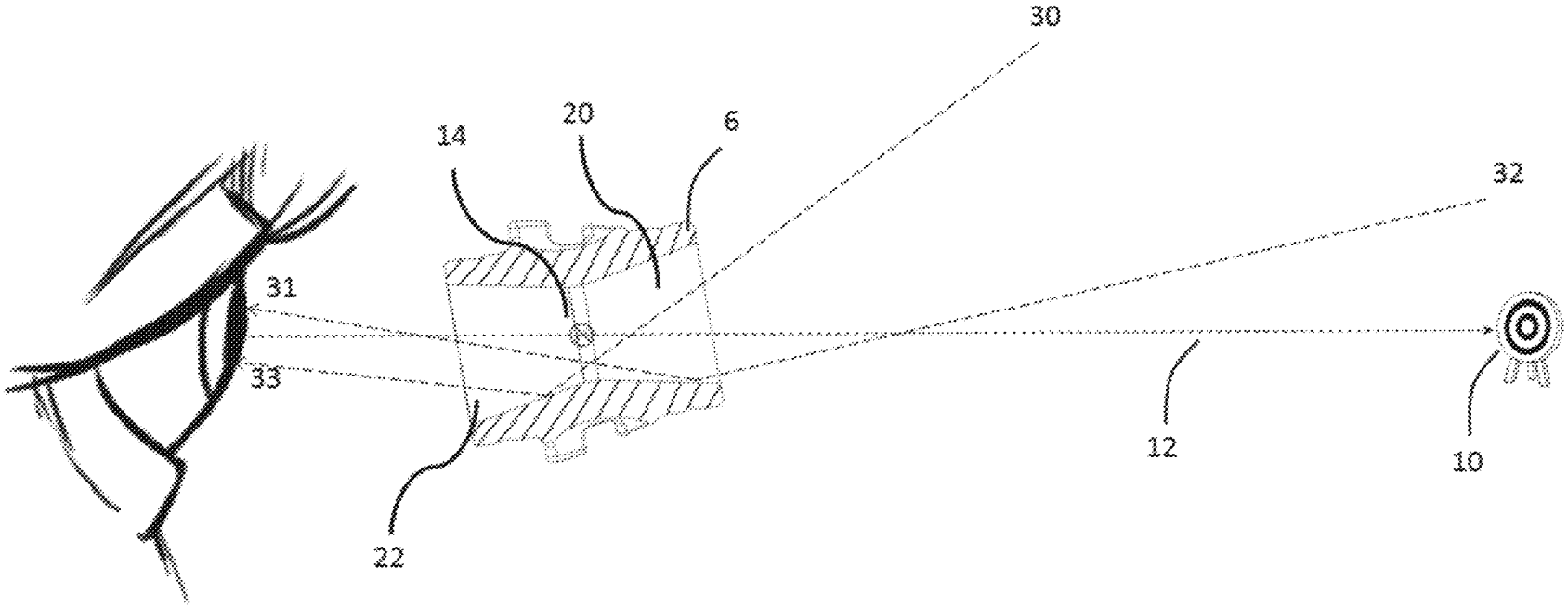
PRIOR ART Fig. 5

Viewfinders having conical shapes provide an angled surface so that the reflected light is directed further away from the user's eye to reduce glare. This is illustrated by FIGS. 2 and 4, which show an archery sighting system with a cone-shaped viewfinder as it may be aligned. However, both types of viewfinders (front and aft) are subject to twisting about their respective mounting locations, which are usually at their longitudinal geometric center, as illustrated by FIGS. 3 and 5.

For a viewfinder mounted in a bow string, the string can twist, resulting in a misalignment of these surfaces from their intended geometry relative to the target (e.g., axially aligned to the line of sight to the target). Likewise for the front or "scope" viewfinder mounted in a bow system, when the bow is drawn back, the bow may twist or rotate due to the asymmetric forces applied to the cable guard. This rotation or twist can also misalign the forward viewfinder. Either viewfinder with smooth surfaces may create unintended geometries that can result in stray light as viewed by the user/archer at low angle of incidence light rays.

Figure 6:
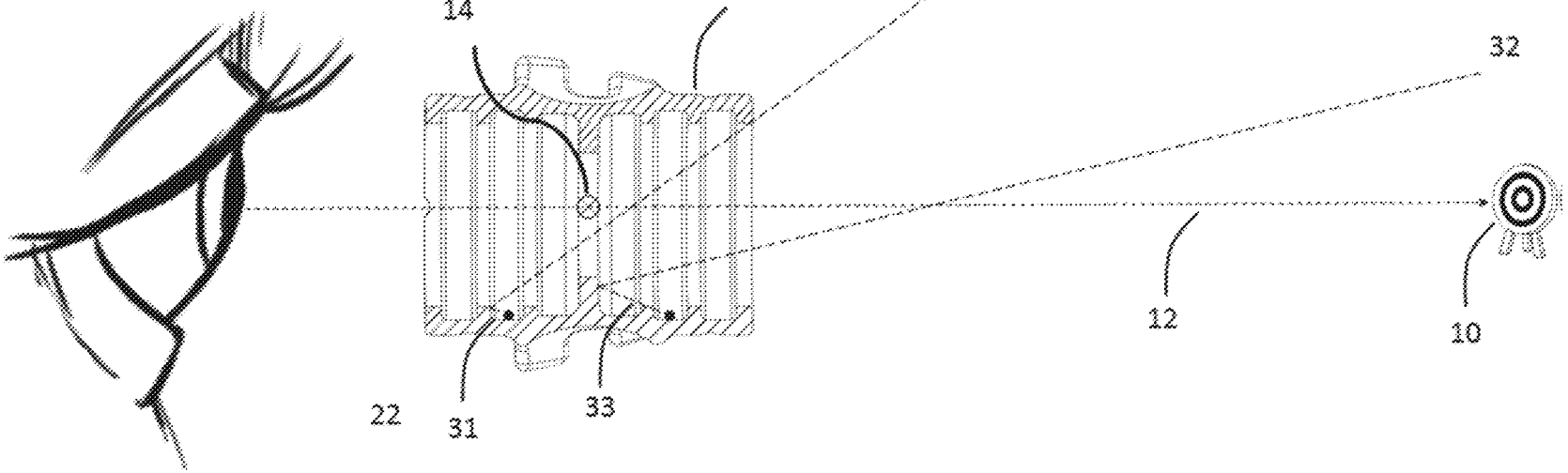
FIGS. 6-7 illustrate an example cylindrical shaped archery viewfinder with baffles disclosed herein, shown both aligned and misaligned.
Figure 7:
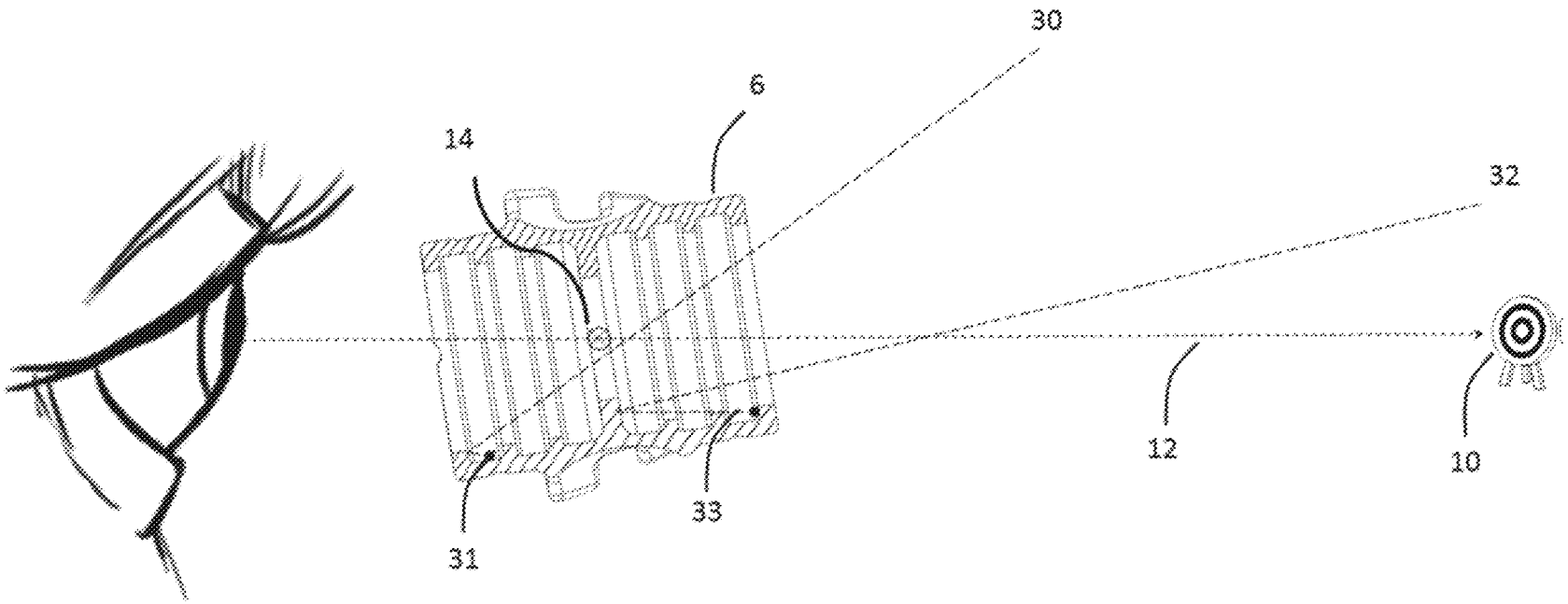

FIGS. 6-7 illustrate an example cylindrical shaped archery viewfinder with baffles disclosed herein, shown both aligned (FIG. 6) and misaligned (FIG. 7). The archery viewfinder disclosed herein has a cylindrical shape and a light baffle. This combination of cylindrical shape with light baffle substantially reduces or even fully eliminates incident stray light from causing glare when viewed or observed by the user. The geometry and light baffle combination addresses both the front (toward target 50) and rear of the viewfinder (toward user 60). However, even if only implemented in one end of the viewfinder, the viewfinder exhibits improved performance.

Figure 8:
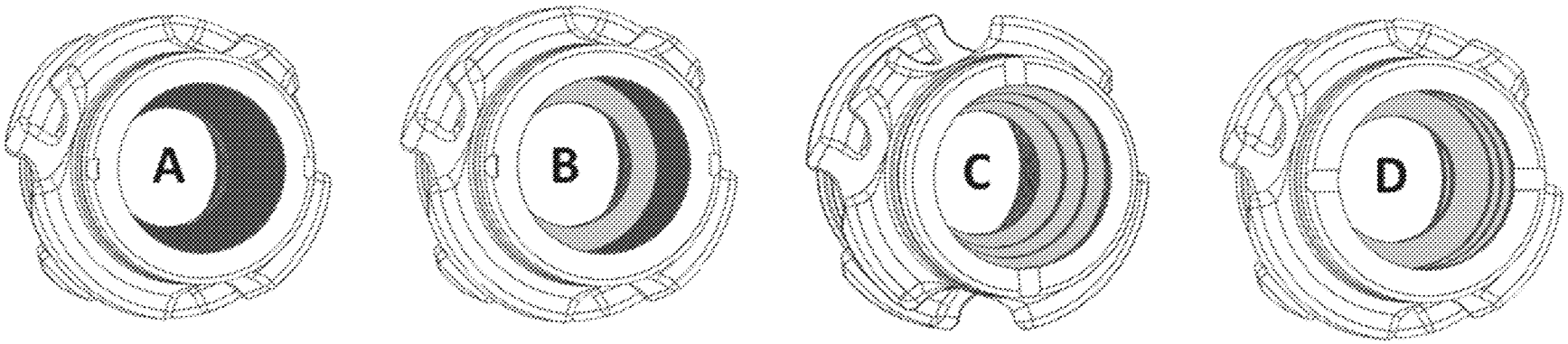
FIG. 8 shows perspective views comparing prior art viewfinder configurations with the archery viewfinder disclosed herein.

In an example, the archery viewfinder enables coaxial alignment with a target, where the front and rear of the viewfinder provide light baffles to block unwanted incident stray light from combining with the observed target scene. FIG. 8 shows perspective views comparing a prior art viewfinder in orientations A and B with the archery viewfinder disclosed herein illustrated in orientations C and D. The surface area observed by the user by incoming incident light is shaded light gray. The center aperture (field stop) opening is colored shaded dark gray. The masked surfaces (in the shadows) by the geometry of the shapes are seen in the center in orientations B and D. It can be seen by this illustration that the viewfinder disclosed herein having cylinders with light baffling provides the optimum geometry for minimizing reflected incident light or glare. This holds, even when the archery viewfinder is misaligned to the line of sight to the target.

Before continuing, it is noted that the examples described herein are provided for purposes of illustration, and are not intended to be limiting. Other devices and/or device configurations may be utilized to carry out the operations described herein. The operations shown and described herein are provided to illustrate example implementations. The operations are not limited to the ordering shown. Still other operations may also be implemented.

It is also noted that as used herein, the terms "includes" and "including" mean, but is not limited to, "includes" or "including" and "includes at least" or "including at least" The term "based on" means "based on" and "based at least in part on."

The term "baffle" as used herein means, but is not limited to a ring surface that is substantially orthogonal to the line of sight and has a diameter larger than the smallest aperture/field stop (generally near the geometric center of the viewfinder) in an optical system where a groove (multiple shapes) where the feature with the largest diameter is greater than the field stop and the baffle diameter.

Figure 9B:
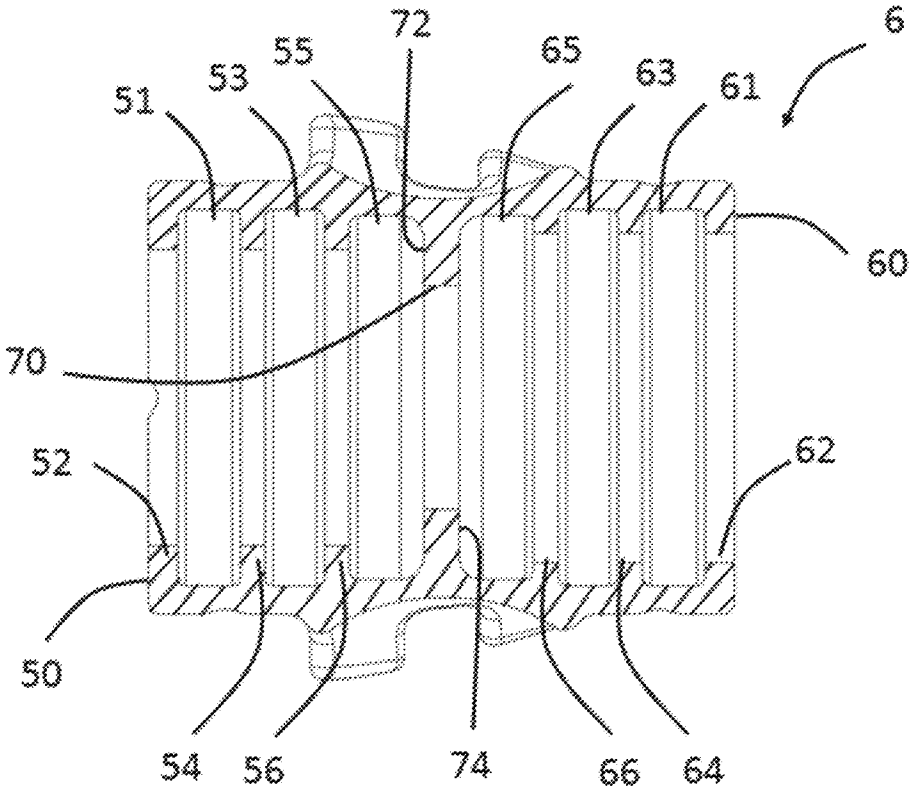
FIG. 9B is the associated cross-sectional view.
Figure 9A:
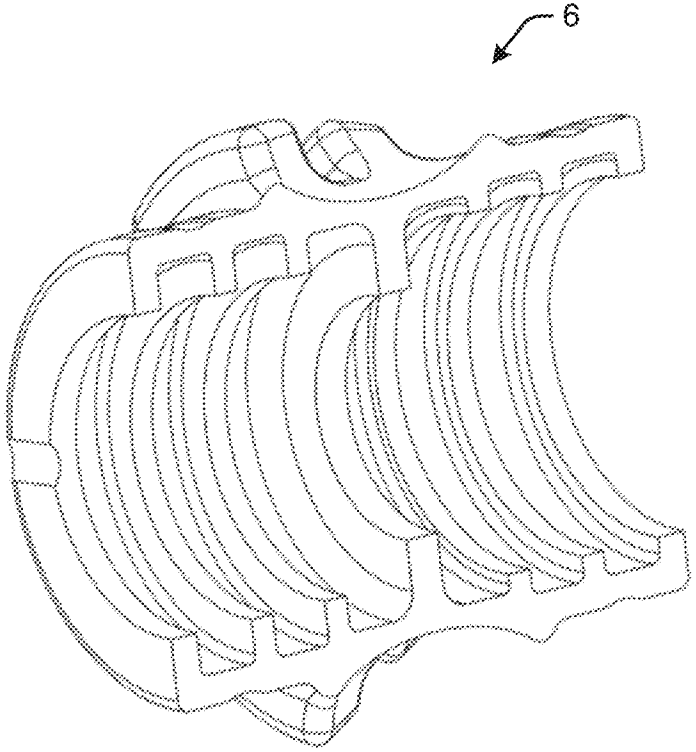
FIG. 9A is a perspective view of an example archery viewfinder.
Figure 10B:
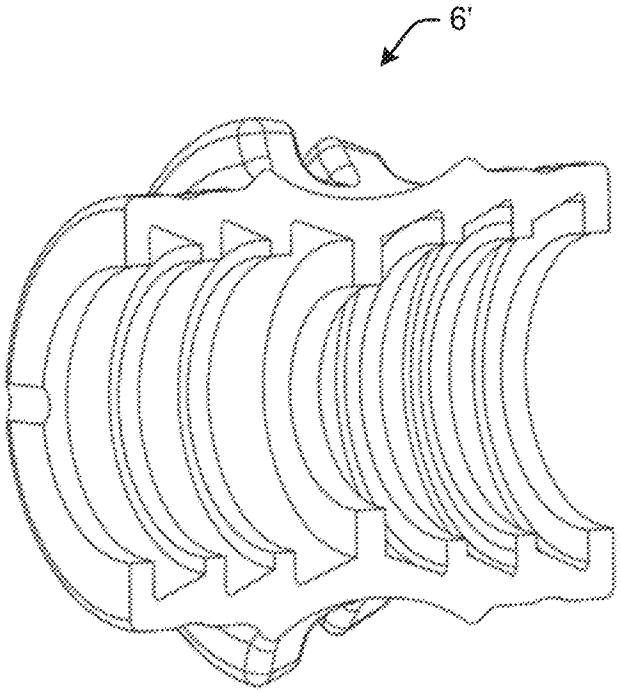
FIG. 10B is the associated perspective view.
Figure 10A:
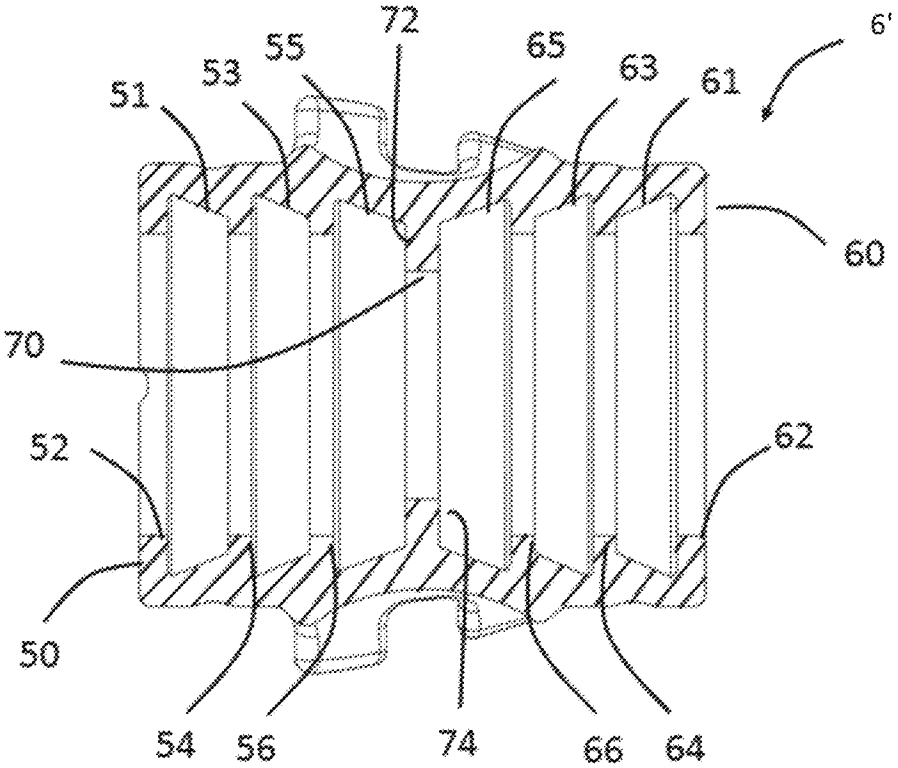
FIG. 10A is a cross-sectional view of another example archery viewfinder.
Figure 11B:
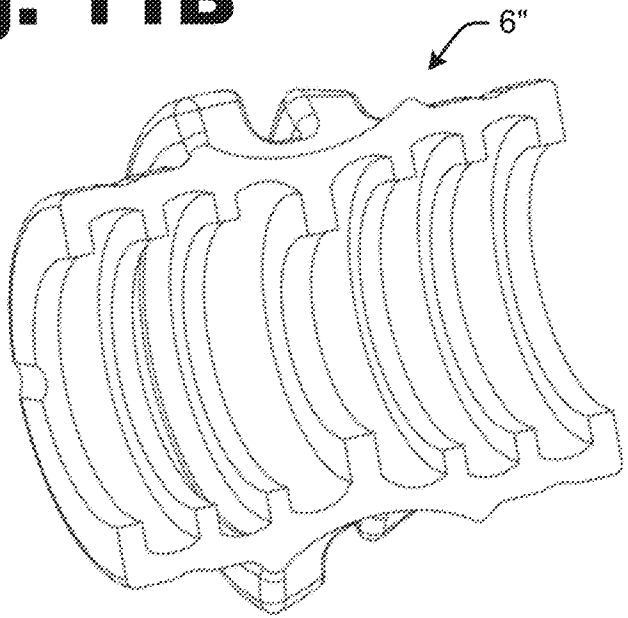
FIG. 11B is the associated perspective view.
Figure 11A:
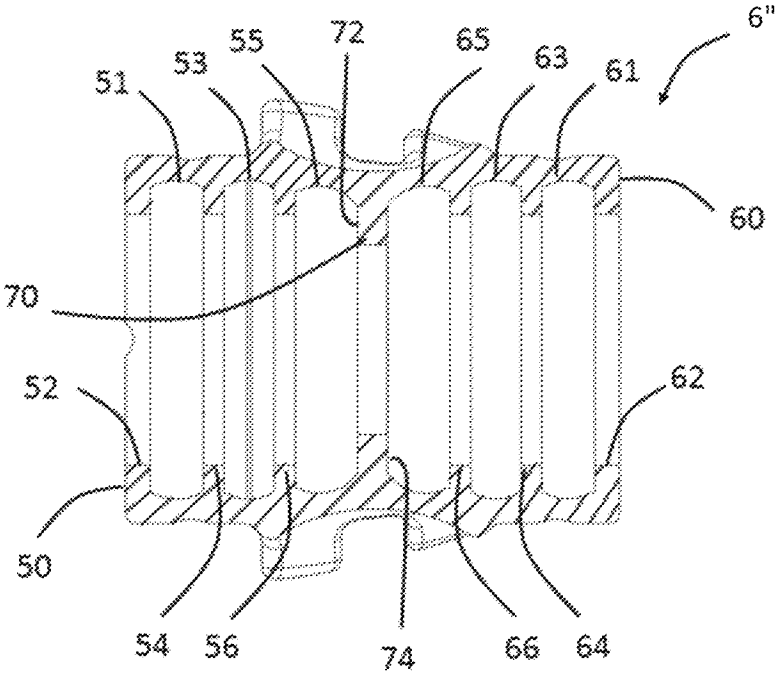
FIG. 11A is a cross-sectional view of another example archery viewfinder.
Figure 12:
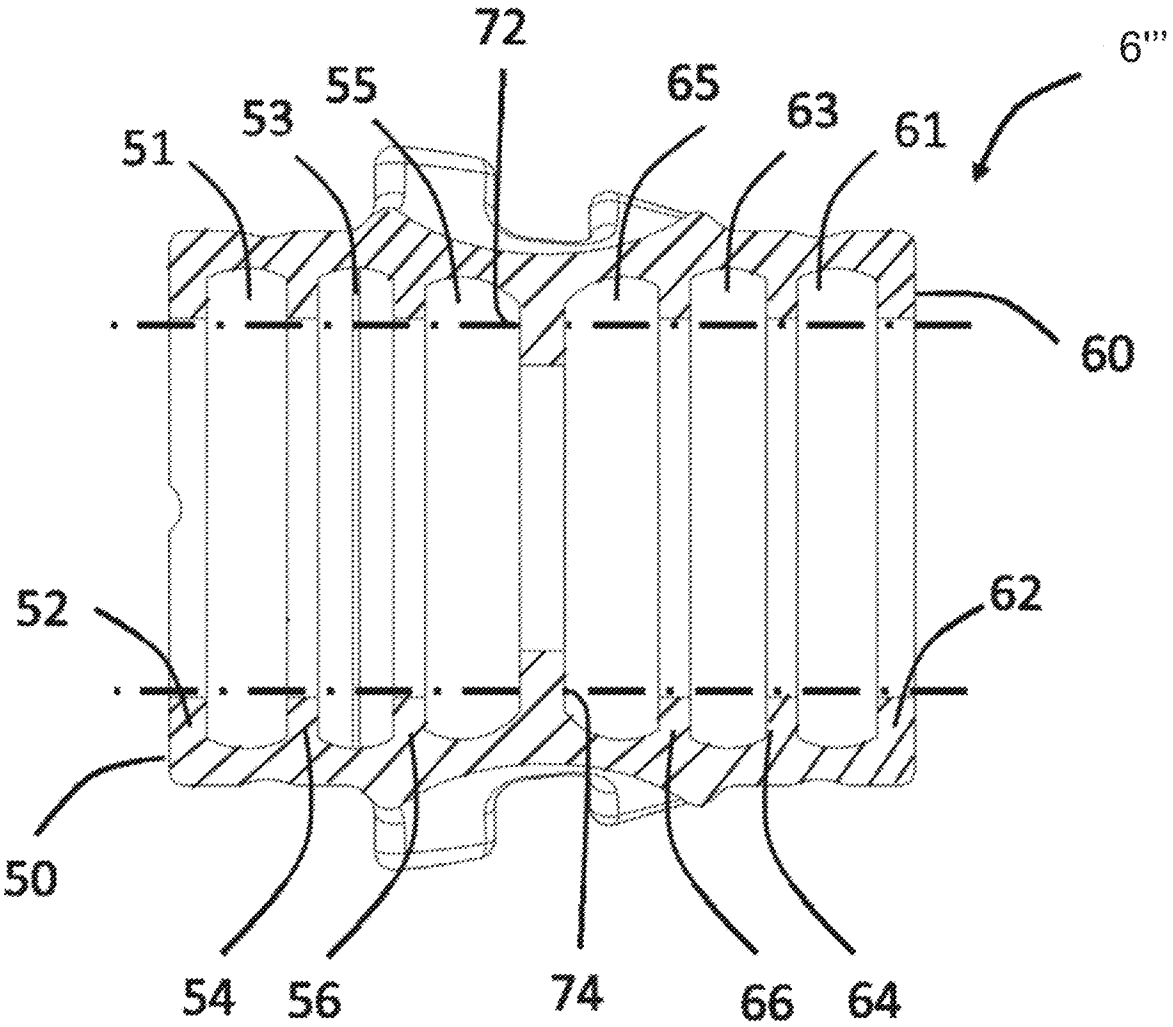
FIG. 12 is a cross-sectional view of another example archery viewfinder.

FIG. 9A is a perspective view of an example archery viewfinder 6, and FIG. 9B is the associated cross-sectional view. FIG. 10A is a cross-sectional view of another example archery viewfinder 6', and FIG. 10B is the associated perspective view. FIG. 11A is a cross-sectional view of another example archery viewfinder 6", and FIG. 11B is the associated perspective view. FIG. 12 is a cross-sectional view of another example archery viewfinder 6'''.

The viewfinder 6 has a geometrically parallel shape (e.g., a polygon or cylinder) in combination with light baffles to provide the best performing anti-glare viewfinder under all geometries that may be implemented by an archery bow system. As such, the archery viewfinder disclosed herein with a forward and aft sections and cylindrical baffled features eliminate glare from being observed by the user. The light baffles effectively redirect incident (off-axis) light generally away from the user.

A forward section of the viewfinder 6, as that term is used herein, refers to the front surface 50 of the viewfinder 6 where the opening aperture diameter 52 is equal to the innermost diameter 56. Where innermost diameter 56 is defined as the end of the cylinder shape formed by propagating the aperture diameter 52 axially until it intersects with an inner surface 72. Where a minimum of one annular groove 51 has a diameter that is greater than the opening aperture 52 and the field stop 70. Additional annular rings 53 and 55 along with baffles 54 and 56 are a function of the length of the forward section (i.e. the longer the sectional length, the more annular rings and grooves necessary to minimize reflected/stray light.)

An aft section of the viewfinder 6, as that term is used herein, refers to the aft surface 60 of the viewfinder 6 where the opening aperture diameter 62 is equal to the innermost diameter 66. Where innermost diameter 66 is defined as the end of the cylinder shape formed by propagating the aperture diameter 62 axially until it intersects with an inner surface 74. Additional annular rings 61, 63, and 65 along with baffles 64 and 66 are a function of the length of the forward section (i.e. the longer the sectional length, the more annular rings are necessary to eliminate the stray light.)

In an example, a third section of the viewfinder 6, as that term is used herein, refers to the intersection of the propagated cylinders of the forward section aperture 52 and aft section aperture 62 as they intersecting with the first inner surfaces 72 and 74. Where the aperture diameter 70 is smaller than the forward aperture 52 and aft aperture 62.

Figure 13B:
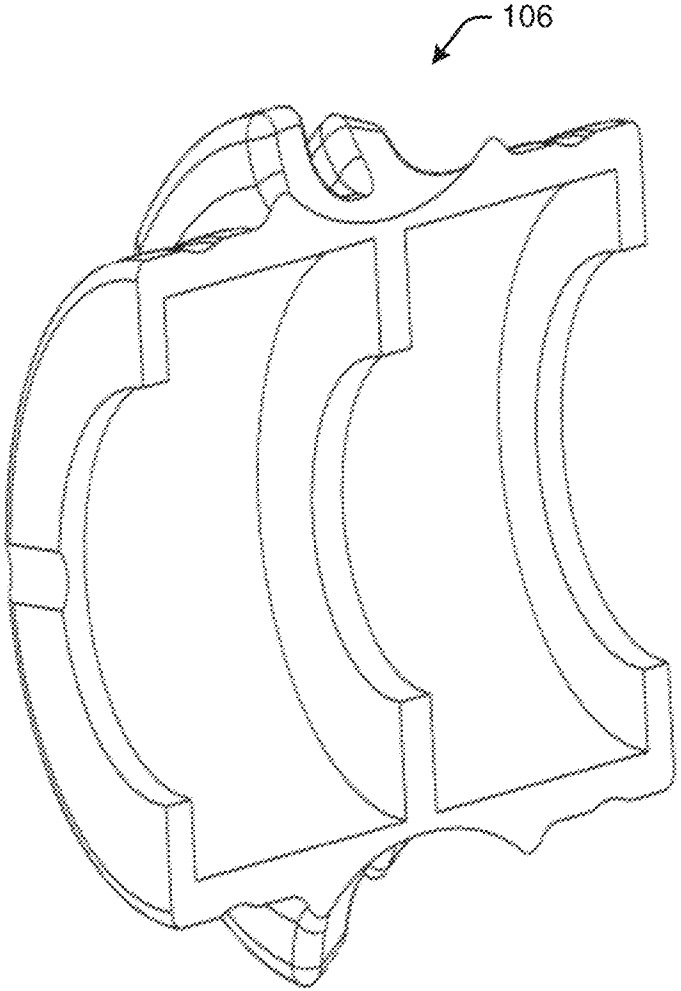
FIG. 13B is the associated perspective view.
Figure 13A:
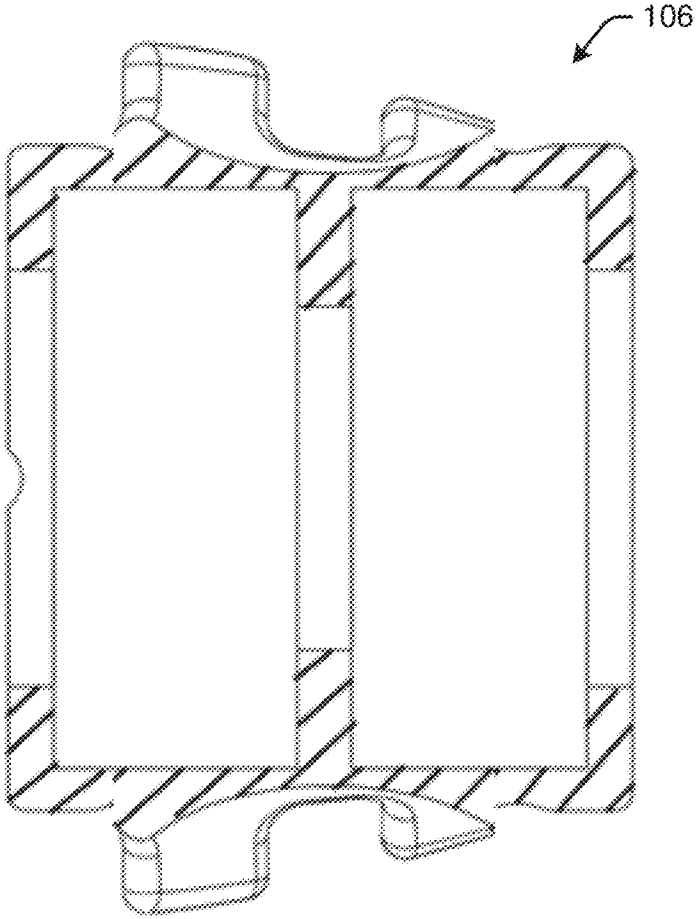
FIG. 13A is a cross-sectional view of another example archery viewfinder with the forward and aft sections defined.
Figure 14B:
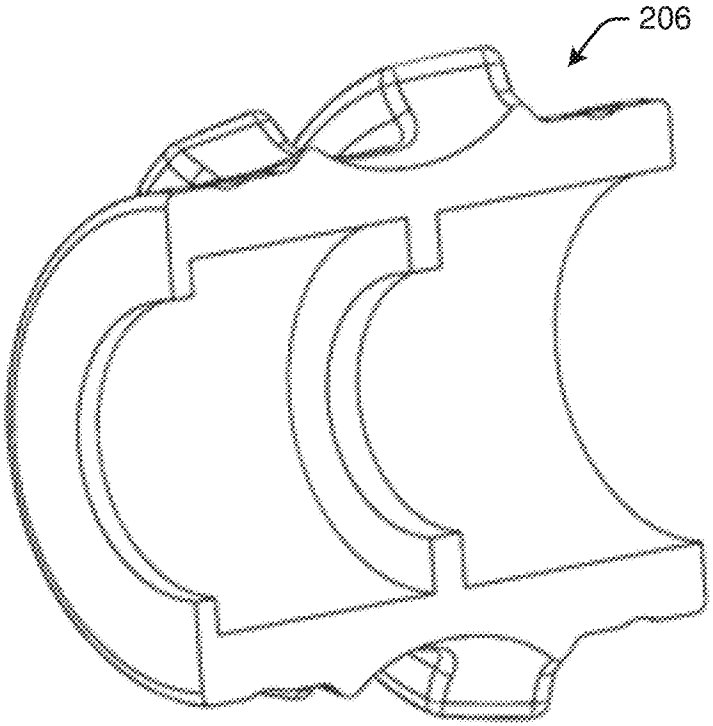
FIG. 14B is the associated perspective view.
Figure 14A:
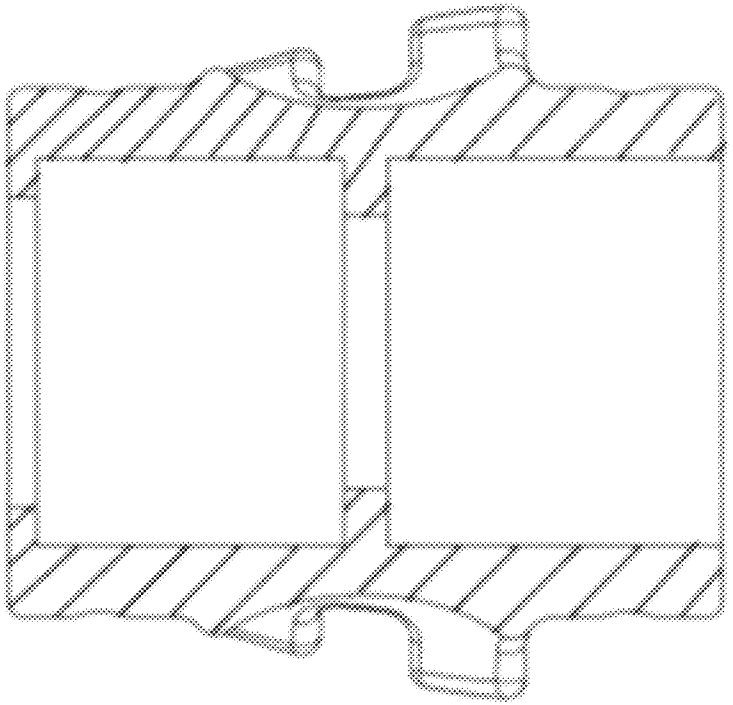
FIG. 14A is a cross-sectional view of another example archery viewfinder.
Figure 15B:
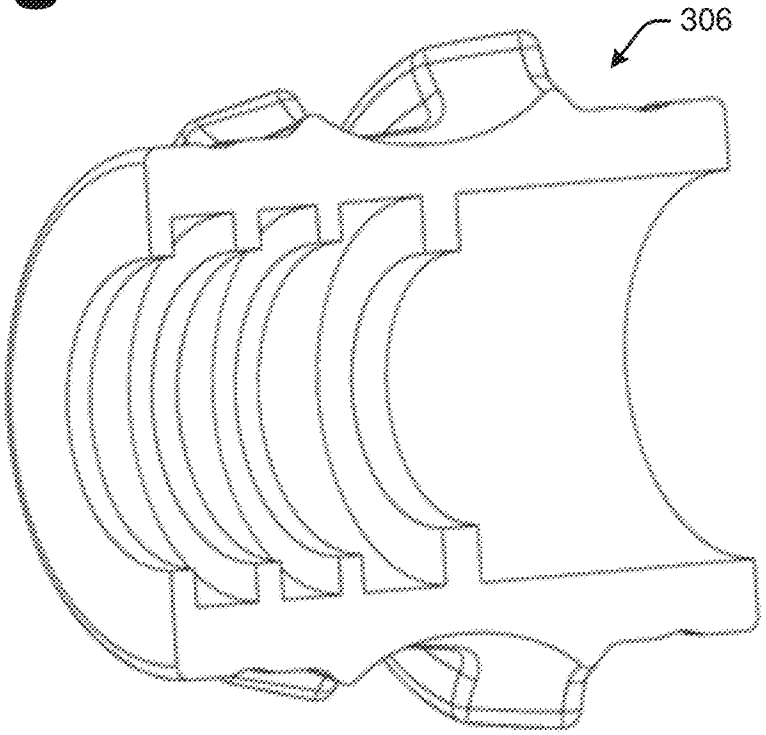
FIG. 15B is the associated perspective view.
Figure 15A:
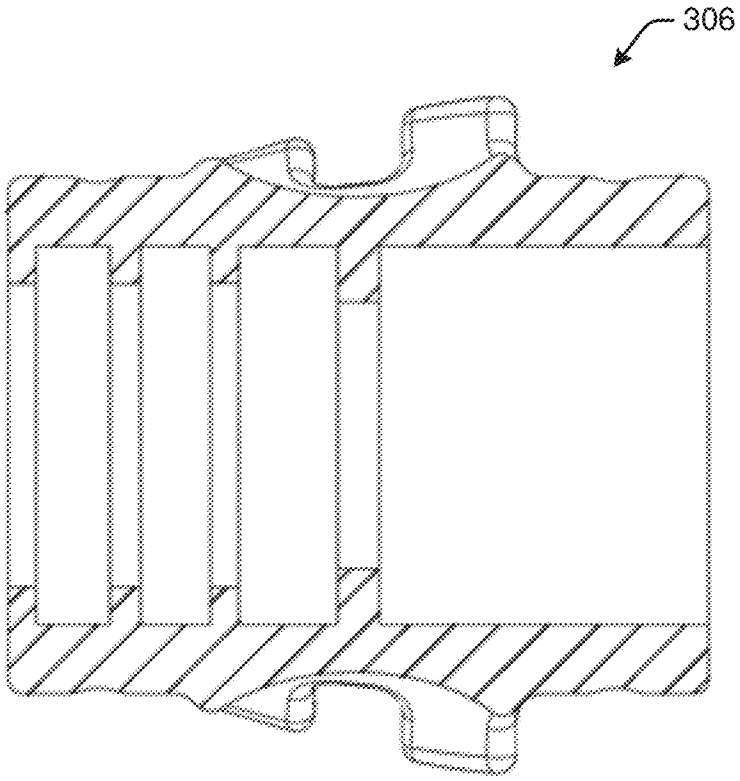
FIG. 15A is a cross-sectional view of another example archery viewfinder.
Figure 16:
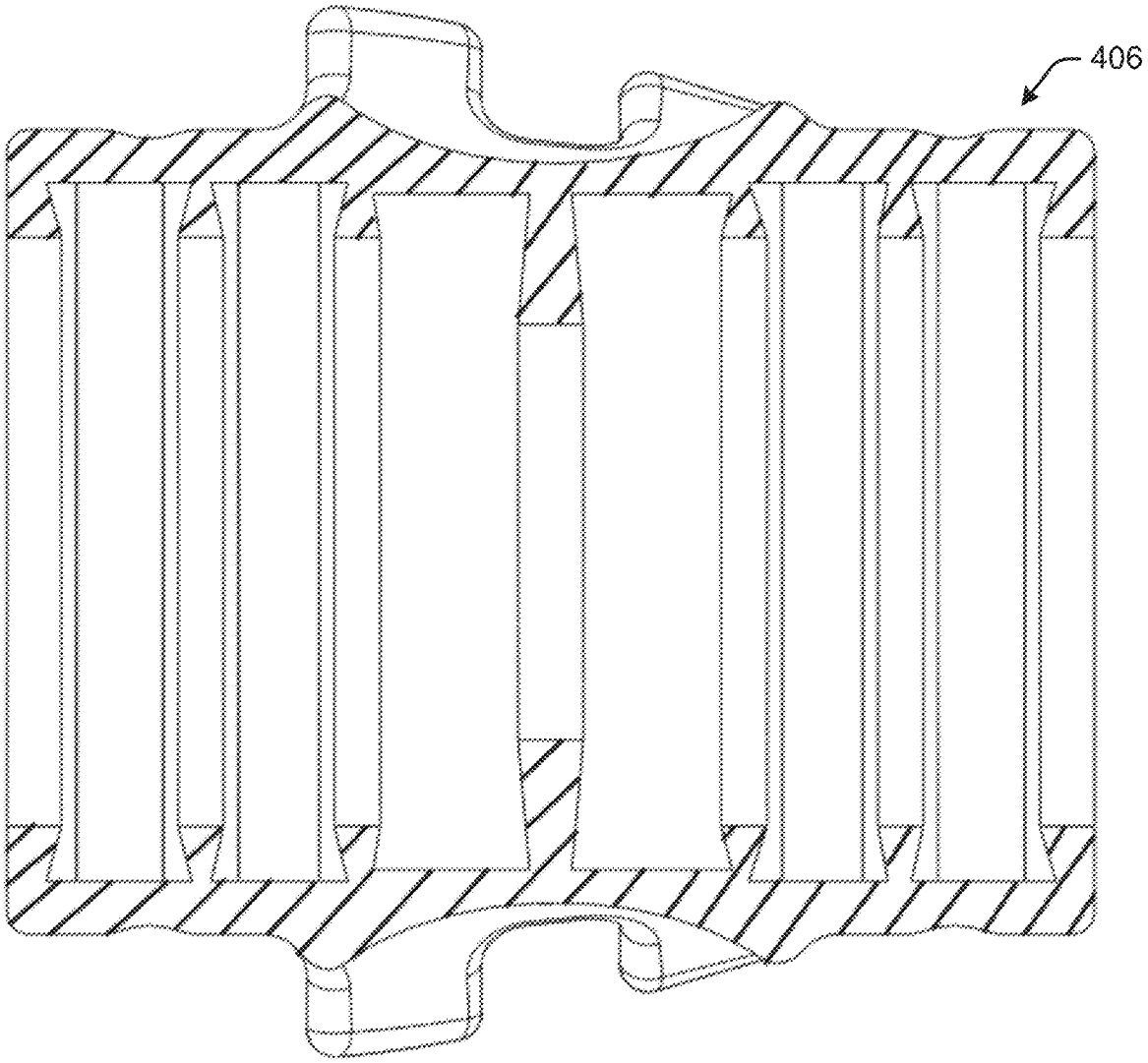
FIG. 16 is a cross-sectional view of another example archery viewfinder having tapered baffles.
Figure 17B:
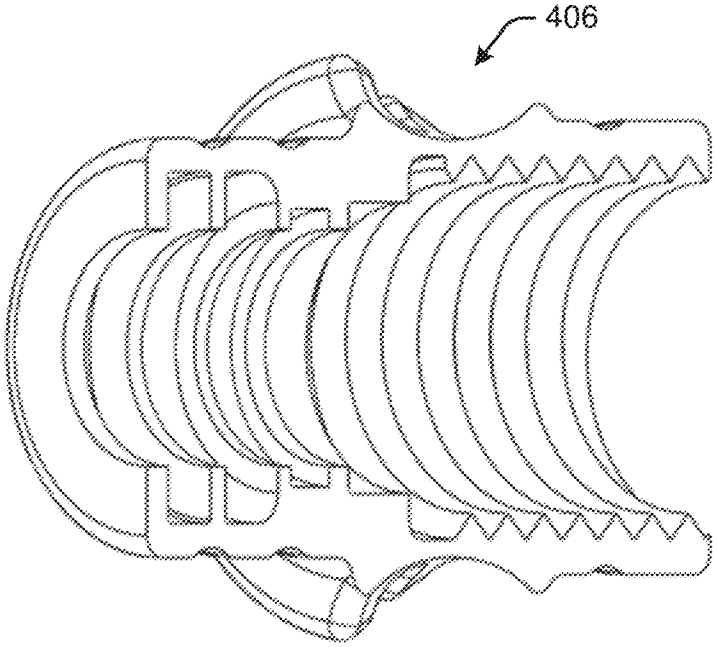
FIG. 17B is the associated perspective view.
Figure 17A:
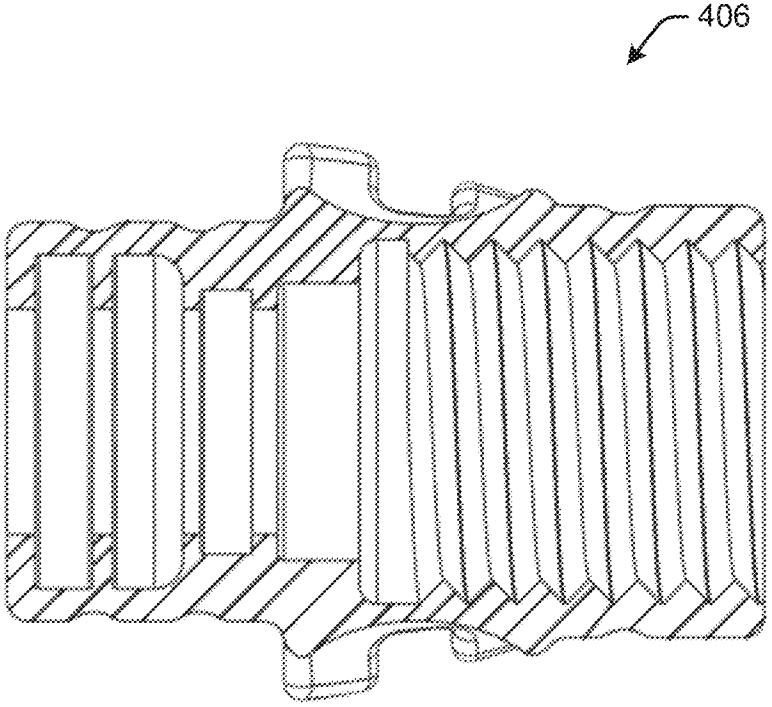
FIG. 17A is a cross-sectional view of the example viewfinder of FIG. 16.
Figure 18:
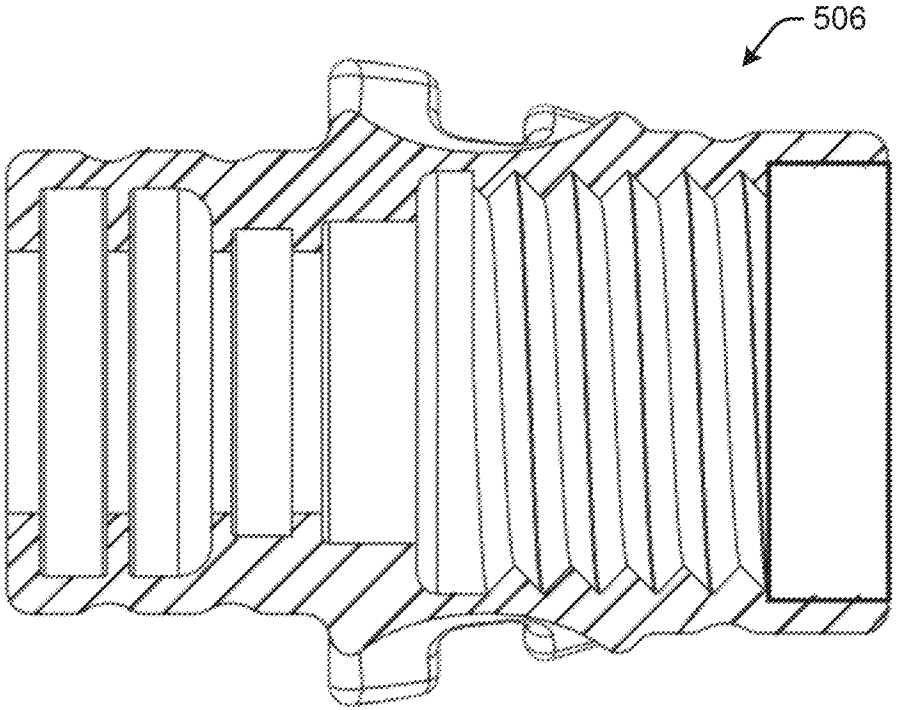
FIG. 18 is a cross-sectional view of another example archery viewfinder showing the forward and aft sections defined.

As noted above, other configurations of the archery viewfinder disclosed herein are also contemplated. FIGS. 13-20 show other example configurations. FIG. 13A is a cross-sectional view of another example archery viewfinder 106 with the forward and aft sections defined, and FIG. 13B is the associated perspective view. FIG. 14A is a cross-sectional view of another example archery viewfinder 206, and FIG. 14B is the associated perspective view. FIG. 15A is a cross-sectional view of another example archery viewfinder 306, and FIG. 15B is the associated perspective view. FIG. 16 is a cross-sectional view of another example archery viewfinder 406 having tapered baffles. FIG. 17A is a cross-sectional view of the example viewfinder 406 of FIG. 16, and FIG. 17B is the associated perspective view. FIG. 18 is a cross-sectional view of another example archery viewfinder 506 showing the forward and aft sections defined.

Still other configurations of the archery viewfinder disclosed herein are also contemplated, as will be readily understood by those having ordinary skill in the art after becoming familiar with the teachings herein.

Figure 19:
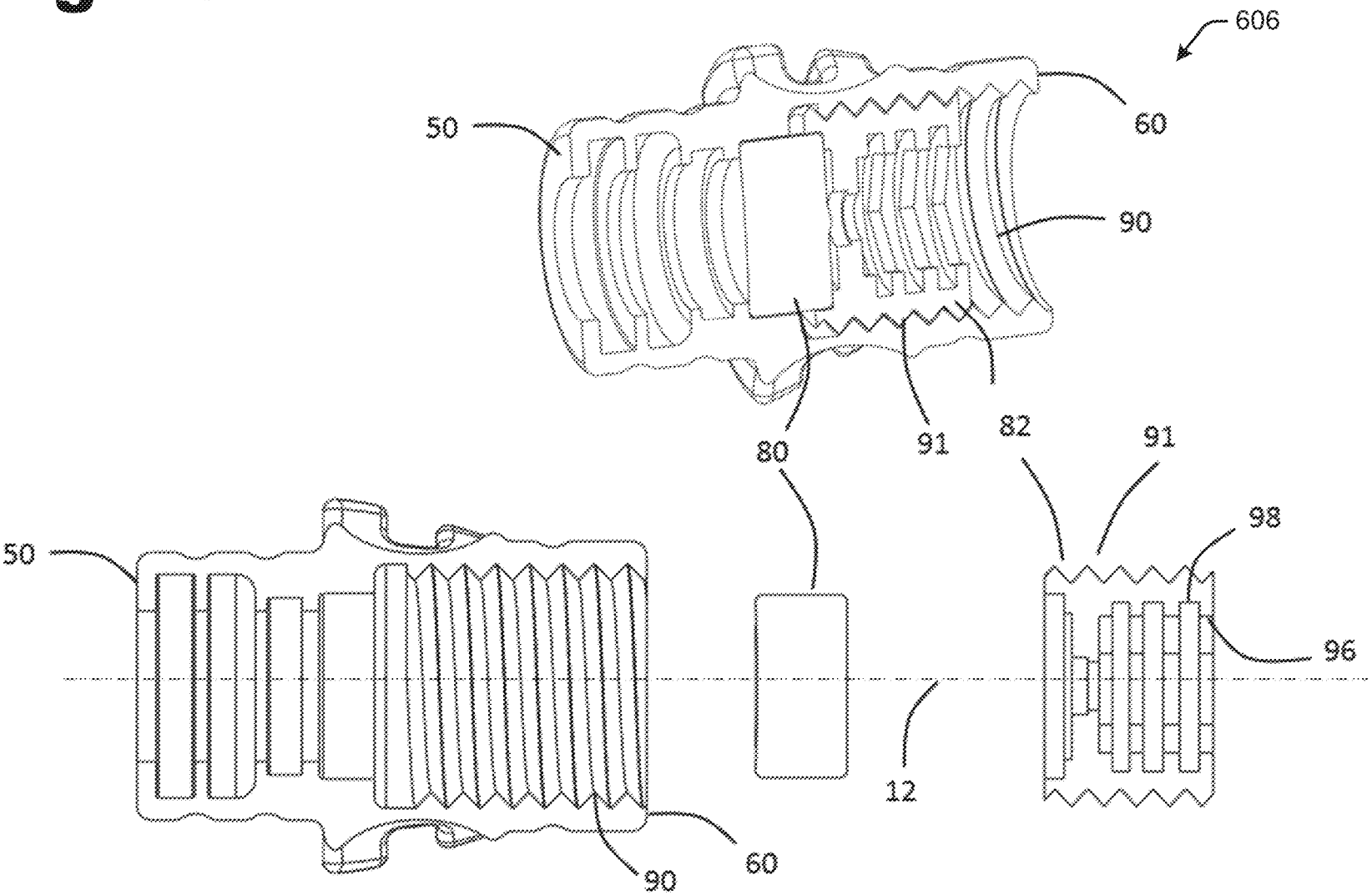
FIG. 19 is a perspective of another example archery viewfinder, cross-section views, showing separate baffle component and lens.
Figure 20:
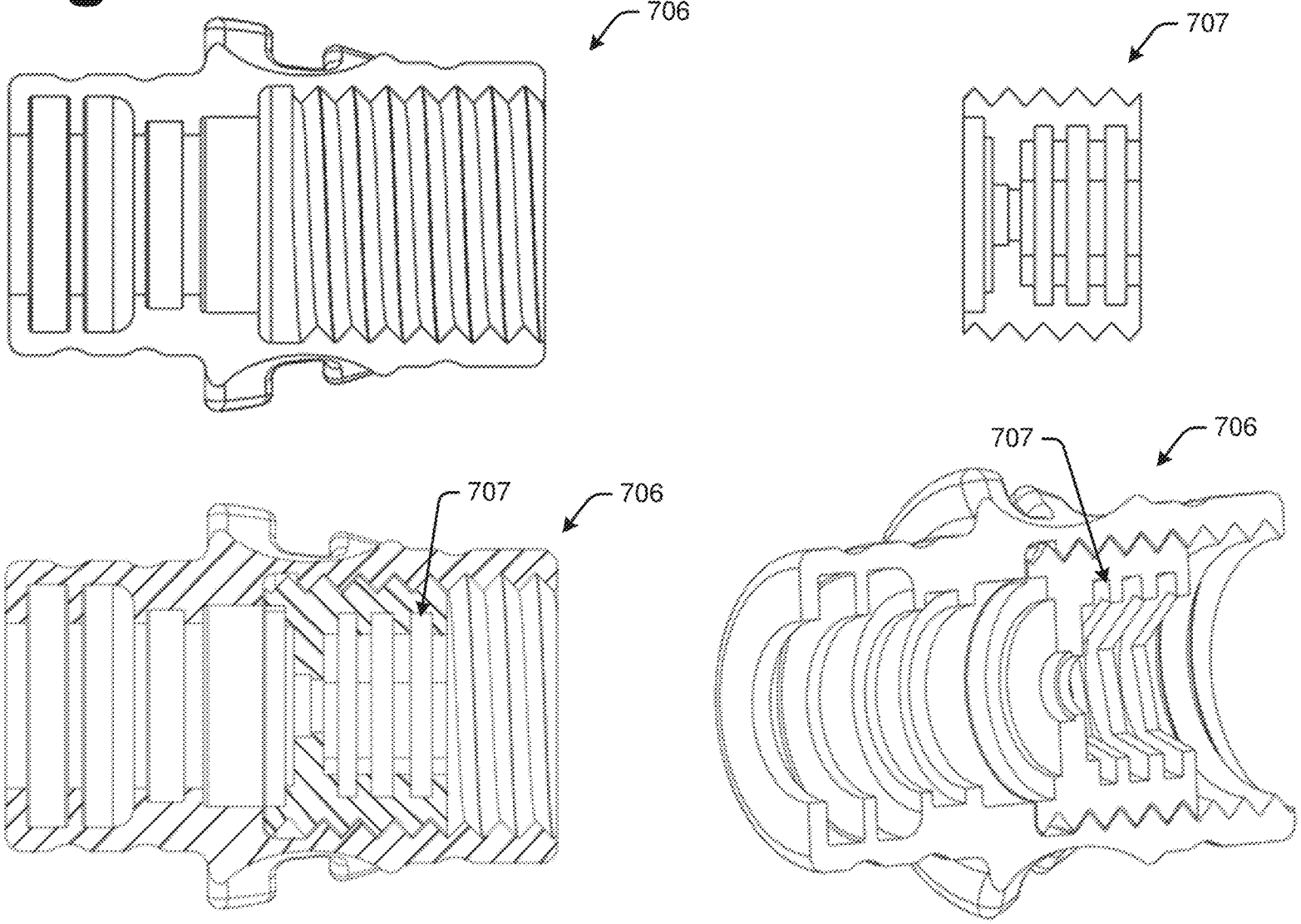
FIG. 20 is a perspective of another example archery viewfinder, cross-section views, showing separate baffle component without lens feature for opto-mechanical centering.

By way of further non-limiting illustration, FIG. 19 is a perspective of another example archery viewfinder 606, cross-section views, showing separate baffle component and lens. FIG. 20 is a perspective of another example archery viewfinder 706, cross-section views, showing a separate baffle component 707 without lens feature for opto-mechanical centering.

These light baffle features can be a part of the archery viewfinder itself. In another example, these features may be provided as a separate element 82 of a viewfinder 6 to include an optical lens 80 that is installed in the body or the viewfinder. In an example, the body has thread 90 and the component has complimentary threaded feature 91. These modular viewfinders can be used with or without a lens 80 depending on the application. In any case, the light baffle is defined by the diameter 96 and the larger diameter defining the groove 98.

It is noted that the examples shown and described are provided for purposes of illustration and are not intended to be limiting. Still other examples are also contemplated.

The invention claimed is:

1. An archery viewfinder, comprising:

a viewfinder housing having an interior cavity; and a plurality of adjacent light baffles in the interior cavity of the viewfinder housing, the plurality of adjacent light baffles separated by a cavity of general cylindrical shape having a larger diameter than an entrance baffle diameter, the plurality of adjacent light baffles forming an opening aperture with a constant diameter;

an innermost light baffle in the viewfinder housing forming a field stop, the field stop having a smaller diameter than a diameter of the plurality of adjacent light baffles;

wherein the plurality of light baffles and the field stop substantially reduces or even fully eliminates incident stray light from causing glare when viewed or observed by a user.

2. The archery viewfinder of claim 1, wherein viewfinder housing is configured to be mounted on both a front toward target position and a rear toward user position in an archery bow system.

3. The archery viewfinder of claim 1, wherein the viewfinder housing has a geometrically parallel shape, the geometrically parallel shape is a polygon.

4. The archery viewfinder of claim 1, wherein the viewfinder housing has a geometrically parallel shape, the geometrically parallel shape is a cylinder.

5. The archery viewfinder of claim 1, wherein the plurality of adjacent light baffles and field stop effectively redirects incident off-axis light generally away from a user of an archery bow system.

6. The archery viewfinder of claim 1, wherein the viewfinder housing has a first section with a front surface having an opening aperture diameter substantially equal to an innermost diameter.

7. The archery viewfinder of claim 6, wherein the innermost diameter is defined as an end of a geometrically parallel shape formed by propagating the opening aperture diameter axially until it intersects with an inner surface of the viewfinder housing.

8. The archery viewfinder of claim 6, wherein additional annular rings are configured as a function of a length of the first section.

9. The archery viewfinder of claim 1, wherein the viewfinder housing has a second section with a second surface having an opening aperture diameter substantially equal to an innermost diameter of the viewfinder housing.

10. The archery viewfinder of claim 9, wherein the innermost diameter is measured from an end of viewfinder housing formed by propagating an aperture diameter axially until it intersects with an inner surface of the viewfinder housing.

11. The archery viewfinder of claim 9, wherein the viewfinder housing has a third section at an intersection of propagated cylinders of a first section aperture and a second aperture intersecting with first inner surfaces of the viewfinder housing.

12. The archery viewfinder of claim 11, wherein an aperture diameter is smaller than the first section aperture and second section aperture.

13. The archery viewfinder of claim 1, further comprising a separate baffle component and lens.

14. The archery viewfinder of claim 1, further comprising a separate baffle component without lens feature for optomechanical centering.

15. The archery viewfinder of claim 1, wherein the viewfinder housing is threaded, and a separate baffle component has a complimentary threaded.

16. The archery viewfinder of claim 1, wherein the plurality of adjacent light baffles form a first set of baffles and a second set of baffles, and further comprising an optical lens in the interior cavity of the viewfinder housing between the first set of baffles and the second set of baffles.

17. The archery viewfinder of claim 16, wherein the second set of baffles is insertable to and removable from the viewfinder housing.

18. An archery viewfinder, comprising:

a viewfinder housing having an interior cavity; and a plurality of adjacent light baffles in the interior cavity of the viewfinder housing, the plurality of adjacent light baffles separated by a cavity of general cylindrical shape with a diameter greater than an entrance baffle diameter, the plurality of adjacent light baffles forming an opening aperture with a constant diameter;

at least one light field stop baffle in the interior cavity of the viewfinder housing having a smaller diameter than the plurality of adjacent light baffles of equal diameters, the at least one light field stop baffle formed by a first diameter of the viewfinder formed by a first diameter of the viewfinder housing and forming a groove between adjacent ridges;

wherein a combination of a geometrically parallel shape, the plurality of adjacent light baffles, and the at least one light field stop baffle substantially reduces or even fully eliminates incident stray light from causing glare when viewed or observed by a user.

19. The archery viewfinder of claim 18, wherein the viewfinder housing has a geometrically parallel shape, the geometrically parallel shape is cylindrical.

20. An archery viewfinder, comprising:

a viewfinder housing having a cylindrical shape, the viewfinder configured to be mounted on at least one of a front toward target position and a rear toward user position in an archery bow system; and a plurality of light baffles in the viewfinder housing, the plurality of light baffles separated by a cavity of general cylindrical shape with a diameter greater than an entrance baffle diameter, the plurality of light baffles forming an opening aperture with a constant diameter;

at least one light baffle in the viewfinder housing having a smaller diameter than the plurality of adjacent light baffles of equal diameters, the at least one light baffle formed by a first diameter of the viewfinder housing;

forming a groove between adjacent ridges;

wherein a combination of a geometrically parallel shape of the housing and the plurality of light baffle, substantially reduces or even fully eliminates incident stray light from causing glare when viewed or observed by a user.

21. The archery viewfinder of claim 20, further comprising a threaded baffle assembly with integrated lens cavity for inserting an optical lens, the threaded baffled assembly enabling bidirectional application of the viewfinder on a bow string.

* * * * *